US007562743B2

(12) United States Patent
Beeson et al.

(10) Patent No.: US 7,562,743 B2
(45) Date of Patent: Jul. 21, 2009

(54) ACOUSTICAL WINDOW AND DOOR COVERING

(75) Inventors: Lisa A. Beeson, Oviedo, FL (US); Joseph G. Gaddone, Oviedo, FL (US)

(73) Assignee: Quietly Making Noise, LLC, Oviedo, FL (US)

( * ) Notice: Subject to any disclaimer, the term of this patent is extended or adjusted under 35 U.S.C. 154(b) by 0 days.

(21) Appl. No.: 11/004,266

(22) Filed: Dec. 2, 2004

(65) Prior Publication Data

US 2006/0118356 A1 Jun. 8, 2006

(51) Int. Cl.
*E06B 5/20* (2006.01)

(52) U.S. Cl. ..... 181/287; 181/284; 181/285; 181/290; 181/294; 181/295; 160/216; 160/223; 160/229.1

(58) Field of Classification Search ..... 181/284, 181/286, 287, 290, 294, 295; 160/216, 223, 160/229.1, 117
See application file for complete search history.

(56) References Cited

U.S. PATENT DOCUMENTS 3,298,457 A * 1/1967 Warnaka ..... 181/290
3,472,305 A 10/1969 Lefes
4,214,646 A * 7/1980 Planes et al. ..... 181/287
4,276,954 A * 7/1981 Romano ..... 181/224
4,357,979 A * 11/1982 Marontate ..... 160/199
4,363,351 A 12/1982 Eriksen
4,387,760 A * 6/1983 Greschbach ..... 160/229.1
4,454,691 A * 6/1984 Mitchell ..... 52/202
4,488,619 A 12/1984 O'Neill
4,620,581 A 11/1986 Wallace
4,658,878 A * 4/1987 Williams ..... 160/84.09
4,863,791 A * 9/1989 Steward et al. ..... 428/310.5
4,961,454 A * 10/1990 Reilly et al. ..... 160/344
5,165,459 A 11/1992 Gaber et al.
5,203,129 A 4/1993 Johnson
5,287,909 A * 2/1994 King et al. ..... 160/135
5,334,806 A * 8/1994 Avery ..... 181/286
5,509,457 A * 4/1996 Jella ..... 160/201

(Continued)

FOREIGN PATENT DOCUMENTS

WO WO 79/01168 12/1979

*Primary Examiner*—Jeffrey Donels
*Assistant Examiner*—Jeremy Luks
(74) *Attorney, Agent, or Firm*—Terry M. Sanks; Mark W. Scott; Beusse Wolter Sanks Mora & Maire, P.A.

(57) ABSTRACT

An acoustical dampening barrier, for an opening in a wall, that is translatable to an open position to allow access to the opening, the fixed barrier including a first barrier layer made of at least one of a rigid and semi-rigid material, a second barrier layer fixed to the first barrier layer on a side of the first barrier layer where a sound to dampen is emitted made of an acoustic material with sound attenuation characteristics, a third barrier layer fixed to the second barrier layer on a side of the second barrier layer where a sound to dampen is emitted made of an acoustic material with sound absorptive characteristics, and a seal material connected to at least one of the opening in the wall, the first barrier layer and the third barrier layer to further dampen a sound emitted when the fixed barrier is translated to a closed position to prevent access to the opening.

16 Claims, 7 Drawing Sheets

U.S. PATENT DOCUMENTS 6,112,851 A * 9/2000 Sugimoto et al. ..... 181/287
6,446,751 B1 * 9/2002 Ahuja et al. ..... 181/295
6,470,952 B1 * 10/2002 Cline et al. ..... 160/188
6,497,266 B1 12/2002 Palmer et al.
6,550,519 B2 4/2003 Green et al.
2004/0140062 A1 * 7/2004 Lee ..... 160/117

* cited by examiner

ACOUSTICAL WINDOW AND DOOR COVERING

BACKGROUND OF THE INVENTION

The present invention relates to window and door coverings, and more particularly to window and door coverings with acoustical materials that block transmission of sound and absorb sound energy.

Windows and doors permit a large amount of sound energy to pass through a building or from one area of a building to another, compared with the solid walls and roofs. Window and door coverings, such as shutters and blinds, are used for a variety of reasons; they have been used for decorative purposes, to provide thermal insulation against heat and cold, and to block the transmission of sunlight.

Existing methods for insulating windows and doors against sound transmission involve expensive, unattractive, and inconvenient modifications, such as adding windows on top of windows, multiple doors in a vestibule arrangement, or permanently installed window "plugs" that are not operable and cannot be easily removed and re-installed. Existing methods use lightweight materials that do not provide sufficient noise reduction in situations where traffic, aircraft, and other noises are occurring exterior to a building. Existing methods address either sound blocking or sound absorption rather than providing both characteristics simultaneously.

With the ever-increasing population density throughout the world, and especially in urban and suburban areas, an improved approach to sound reduction using window and door coverings is necessary. This invention provides sound reduction and absorption in various embodiments that allow for operability, ease of installation, and a variety of aesthetic choices for both new construction and retrofit applications, to allow for quieter, more pleasant living, sleeping, and working environments within buildings.

SUMMARY OF THE INVENTION

The present invention is directed to an apparatus for significantly reducing an amount of noise that is emitted through an opening in a wall, such as but not limited to a window or door. Towards this end, an acoustical dampening barrier for an opening in a wall that is translatable to an open position to allow access to the opening is disclosed. The barrier including a first barrier layer made of at least one of a rigid and semi-rigid material, a second barrier layer made of an acoustic material with sound attenuation characteristics that is fixed to the first barrier layer on a side of the first barrier layer where a sound to dampen is emitted, and a third barrier layer made of an acoustic material with sound absorptive characteristics that is fixed to the second barrier layer on a side of the second barrier layer where a sound to dampen is emitted. A seal material is also disclosed that is connected to the opening in the wall, the first barrier layer and/or the third barrier layer to further dampen a sound emitted when the fixed barrier is translated to a closed position to prevent access to the opening. In one preferred embodiment, a track system is also included for securing the first barrier layer, the second barrier layer and the third barrier to the opening and/or allowing the first barrier layer, the second barrier layer and the third barrier to be translated between the open position and the closed position.

In another preferred embodiment, an acoustic reduction system for use with at least one of a door and a window is disclosed. The system comprises a barrier connected to a frame of either the door or window. The barrier comprises a first barrier layer made of at least one of a rigid and semi-rigid material, a second barrier layer made of an acoustic material with sound attenuation characteristics that is fixed to the first barrier layer on a side of the first barrier layer where a sound to dampen is emitted, and a third barrier layer made of an acoustic material with sound absorptive characteristics that is fixed to the second barrier layer on a side of the second barrier layer where a sound to dampen is emitted. A seal material is connected to the frame and/or the barrier to further close an opening between the frame and the barrier. In another preferred embodiment, a track system is further provided for securing the barrier to the frame and/or allowing the barrier to be translated between the open position and the closed position.

In another preferred embodiment of the present invention, an improvement for a window shutter system having a plurality of decorative shutter slats that is placed inside a window is disclosed. The improvement comprises a first barrier layer made of an acoustic material with sound attenuation characteristics fixed to each individual decorative shutter slat of the plurality of decorative shutter slats on a side of the shutter where a sound to dampen is emitted. The improvement further includes a second barrier layer made of an acoustic material with sound absorptive characteristics fixed to the first barrier layer on a side of the first barrier layer where a sound to dampen is emitted.

BRIEF DESCRIPTION OF THE DRAWINGS

The figures shown depict only a sample of configurations that may be employed for the present invention. Those skilled in the art will recognize variations to the figures presented herein. The features and advantages of the present invention will become apparent from the following detailed description of the invention when read with the accompanying drawings in which.

DETAILED DESCRIPTION OF THE INVENTION

Before proceeding to a detailed description of the preferred embodiment of the present invention and alternate embodiments, several general comments should be made about the applicability and the scope of the present invention.

Figure 1:
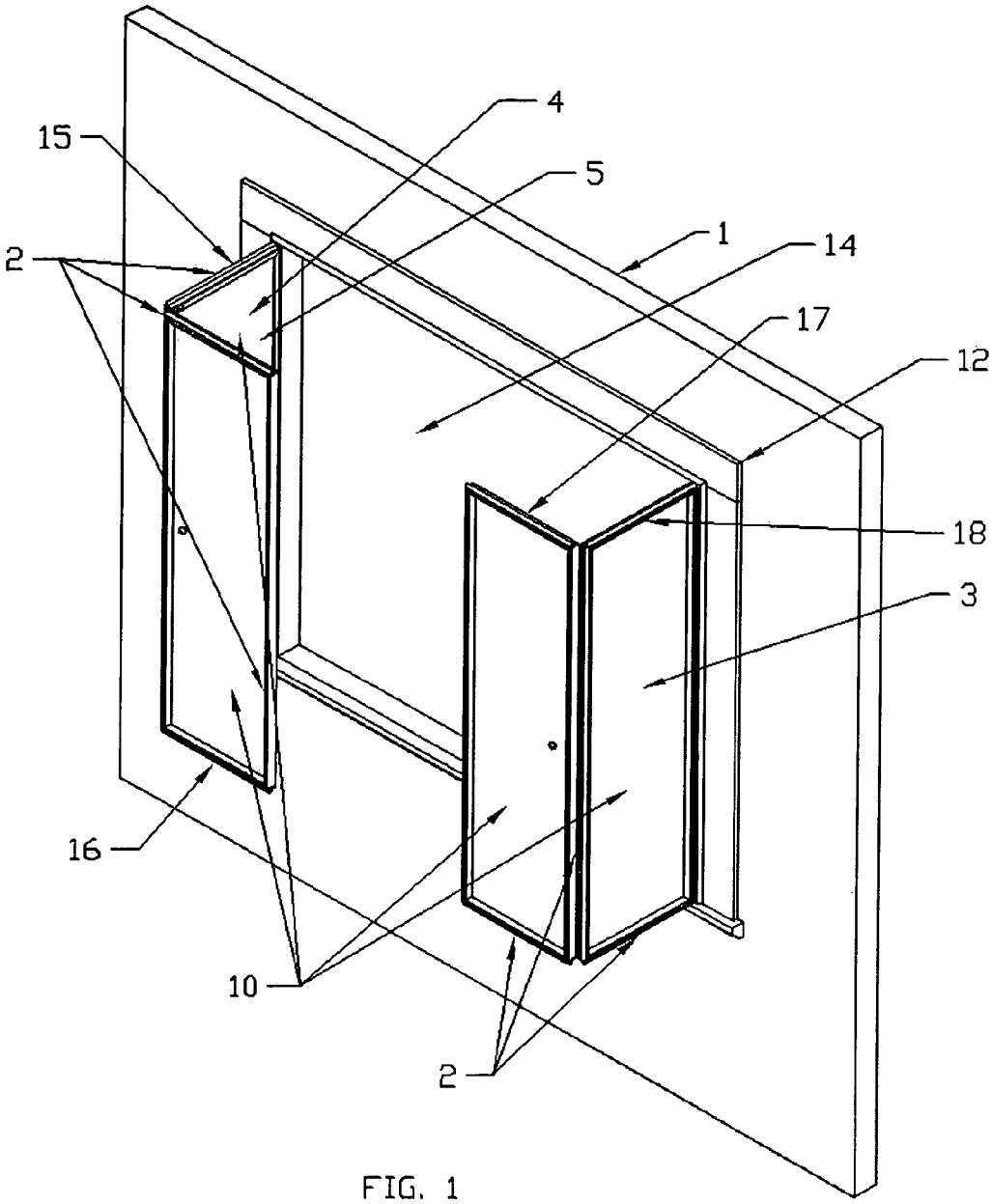
FIG. 1 is a perspective view of a preferred embodiment of bi-fold shutter coverings installed inside a window frame.
Figure 7:
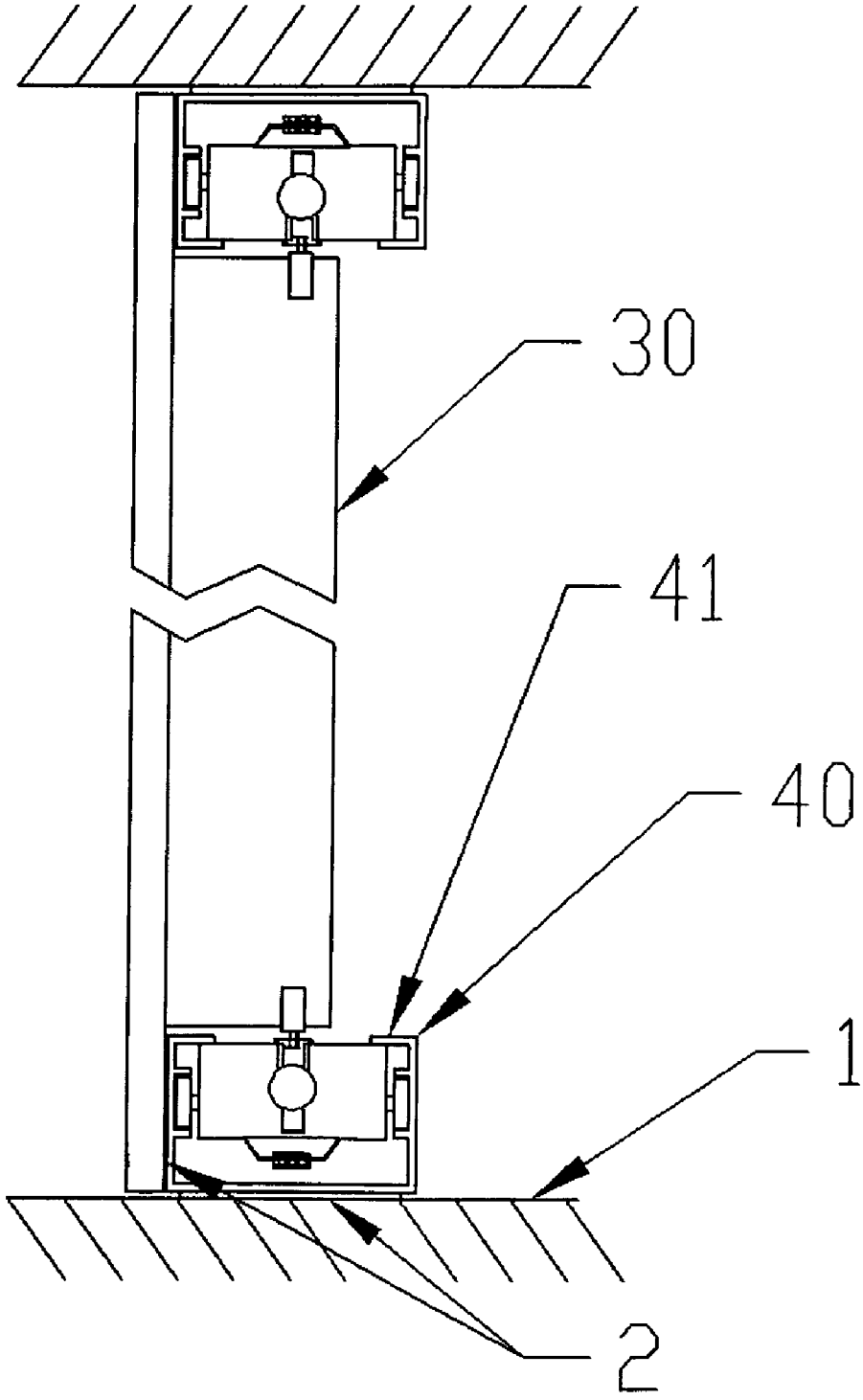
FIG. 7 is an illustration of a preferred embodiment of a track that is used to create a positive seal between vertical and/or horizontal slats and a window frame.

First, while FIG. 1 illustrates a multiple door shutter with four doors, any number of door sections may be used to cover larger or smaller openings within the scope of the invention. Furthermore even though variations of the use of shutter doors is illustrated, these are only exemplary embodiments and those skilled in the art will readily recognize other variations that are possible that are still within the scope of the invention. Second, while the present invention illustrates three layers of material to make up the covering, more or fewer layers may be used to achieve the same acoustical properties without departing from the intended scope of the invention. Third, the cross-sectional shape of the vanes can vary without departing from the intended scope of the invention. Fourth, while FIG. 7 illustrates a design for a track that is used to create a complete positive seal between slats, other track designs may be used without departing from the intended scope of the invention. Finally, while the invention is disclosed as being used for windows and doors, the scope of the invention is also applicable with other apparatus that would benefit from a reduction of noise being transmitted therethough, such as a wall in a multi-room conference facility. Fifth, though illustrated embodiments show the invention connected or attached to a frame or wall, in another exemplary embodiment, the present invention is completely removable from a wall and/or frame, instead of being hinged, sliding or on a track. Finally, the 3-layers of material described herein is the minimum number of layers for proper functionality and performance, but there could be more than 3 layers. For example, use of two layers of a mass loaded vinyl may be used, and/or acoustically absorptive fabric may be used on both exterior sides of the assembly.

Now proceeding to a description of FIG. 1, a partial wall section 1 is shown. In this preferred embodiment a shutter assembly 10, having four shutter doors 15, 16, 17, 18, is shown installed inside a window frame 12. The shutter assembly 10 is shown with three layers, an outer decorative layer 3 which can be made of wood, plastic or any rigid material. An inner layer 4 is made of an acoustic material designed with high sound attenuation characteristics to block sound transmission through the shutter 10. An additional layer 5 facing the window 14 or door (not shown) is made of an acoustic material designed with high sound absorptive characteristics. The shutter doors 15, 16, 17, 18 are hinged and may be swung out of the way to allow access to the window 14. When the doors 15, 16, 17, 18 are closed a flexible seal 2 contacts the frame 12 and makes a positive seal. Flexible seals 2 are also installed between doors 15, 16, 17, 18 for a positive seal. A positive seal results when no openings remain through which sound could pass without first encountering either the seals, or the layers of material described above. As illustrated, the flexible seals 2 are connected either around the perimeter of the door or window. In another preferred embodiment, the flexible seals are attached to the window frame or doorframe.

Figure 2:
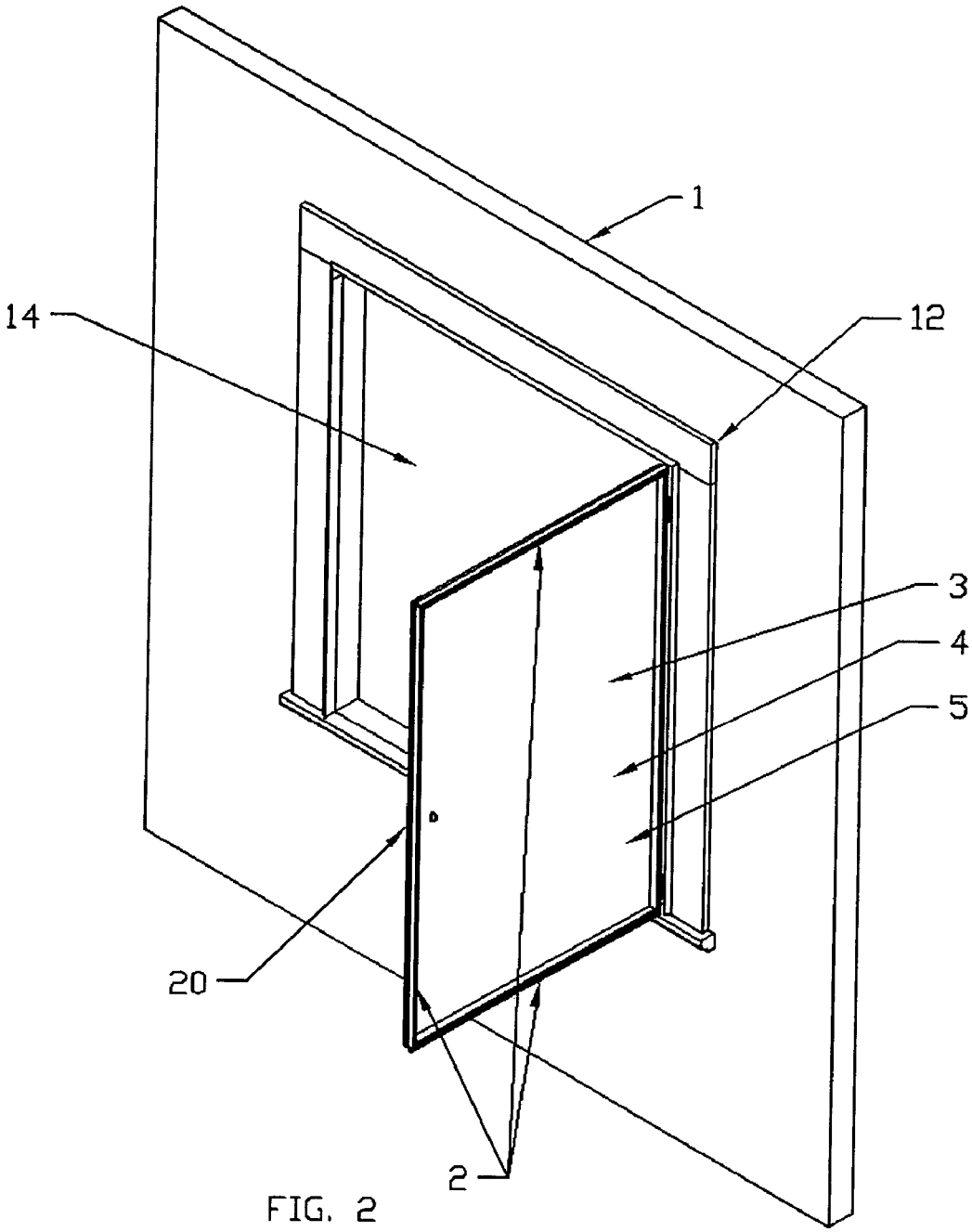
FIG. 2 is a perspective view of a preferred embodiment of a single-door shutter covering installed inside a window frame.

A preferred embodiment of the invention is shown in FIG. 2. This embodiment shows a partial wall section 1 with single door shutter 20. In this embodiment the shutter 20 is shown installed inside a window frame 12. The shutter 20 is shown with three layers, an outer decorative layer 3 which can be made of wood, plastic or any rigid material. An inner layer 4 is made of an acoustic material designed with high sound attenuation characteristics to block sound transmission through the shutter. An additional layer 5 facing the window or door is made of an acoustic material designed with high sound absorptive characteristics. As illustrated, the shutter 20 is hinged to a side of the frame 12 and may be swung out of the way to allow access to the window 14 or door (not shown). When the door 20 is closed a flexible seal 2 contacts the frame 12 and makes a positive seal. In another preferred embodiment, the flexible seals are attached to the window frame or doorframe.

Figure 3:
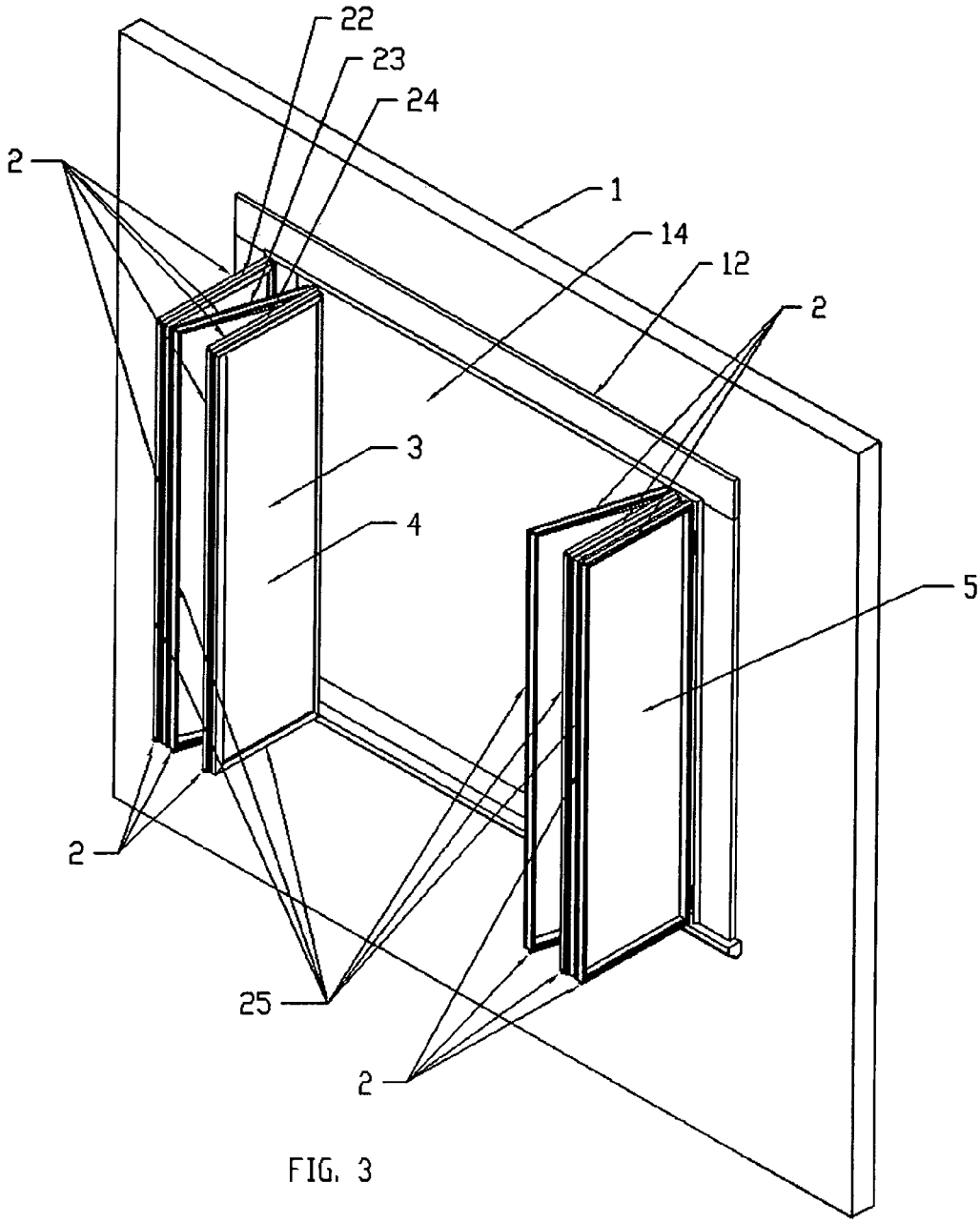
FIG. 3 is a perspective view of a preferred embodiment of multi-fold shutter coverings installed inside a window frame.

Yet another preferred embodiment of the invention is shown in FIG. 3. This embodiment shows multiple-door shutters. As illustrated, three door panels 22, 23, 24 are shown but additional panels may be used if desired. In this embodiment the shutter assembly 25 is shown installed inside a window frame 12. Each panel 22, 23, 24 of the shutter assembly 25 is shown with three layers, an outer decorative layer 3 which can be made of wood, plastic or any rigid material. An inner layer 4 is made of an acoustic material designed with high sound attenuation characteristics to block sound transmission through the shutter. An additional layer 5 facing the window or door is made of an acoustic material designed with high sound absorptive characteristics. The doors 22, 23, 24 are hinged and may be swung out of the way to allow access to the window 14 or door (not shown). When the shutter assembly 25 is closed a flexible seal 2 contacts the frame 12 and makes a positive seal. Flexible seals 2 are also installed between door sections 22, 23, 24.

Figure 4:
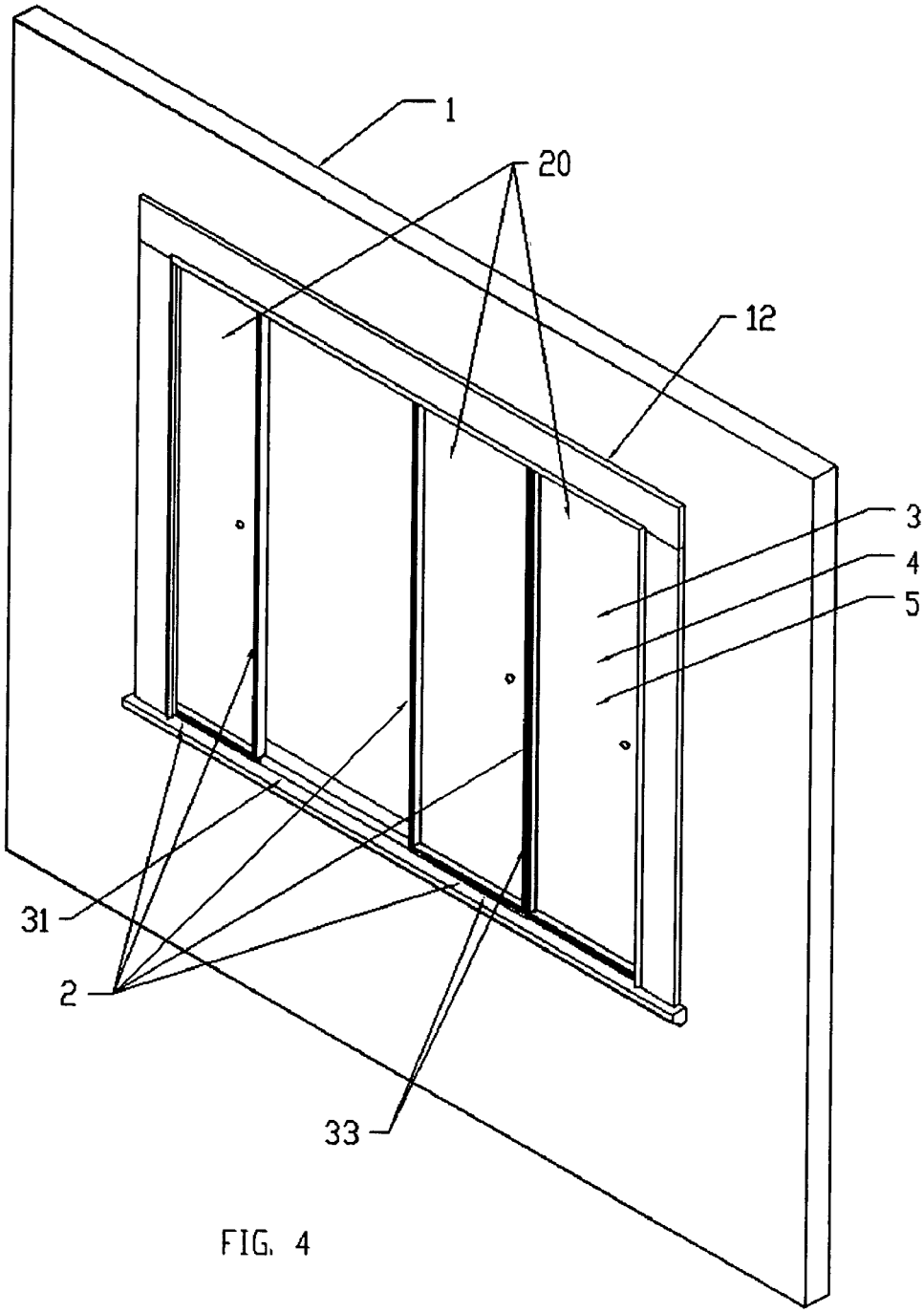
FIG. 4 is a perspective view of a preferred embodiment of sliding multiple door shutters installed on a track within a window frame.

Another preferred embodiment is illustrated in FIG. 4. As illustrated, the door sections ride upon a track 31 that is fixed to and/or within the frame 12. When fully opened, the doors are hidden within the wall section 1. As with the prior described embodiments, the door sections 20 have an outer decorative layer 3, an inner high sound attenuation layer 4, and an additional high sound absorption layer 5. Flexible seals 2 are placed along edges of the tracks 31 and on an edge 33 of the door sections 20 that contact an adjacent door section to insure that the door panels contact the track, each other, and make positive seals at these locations. Though a plurality of doors 20 are illustrated a single sliding door 20 may also be used.

Figure 5:
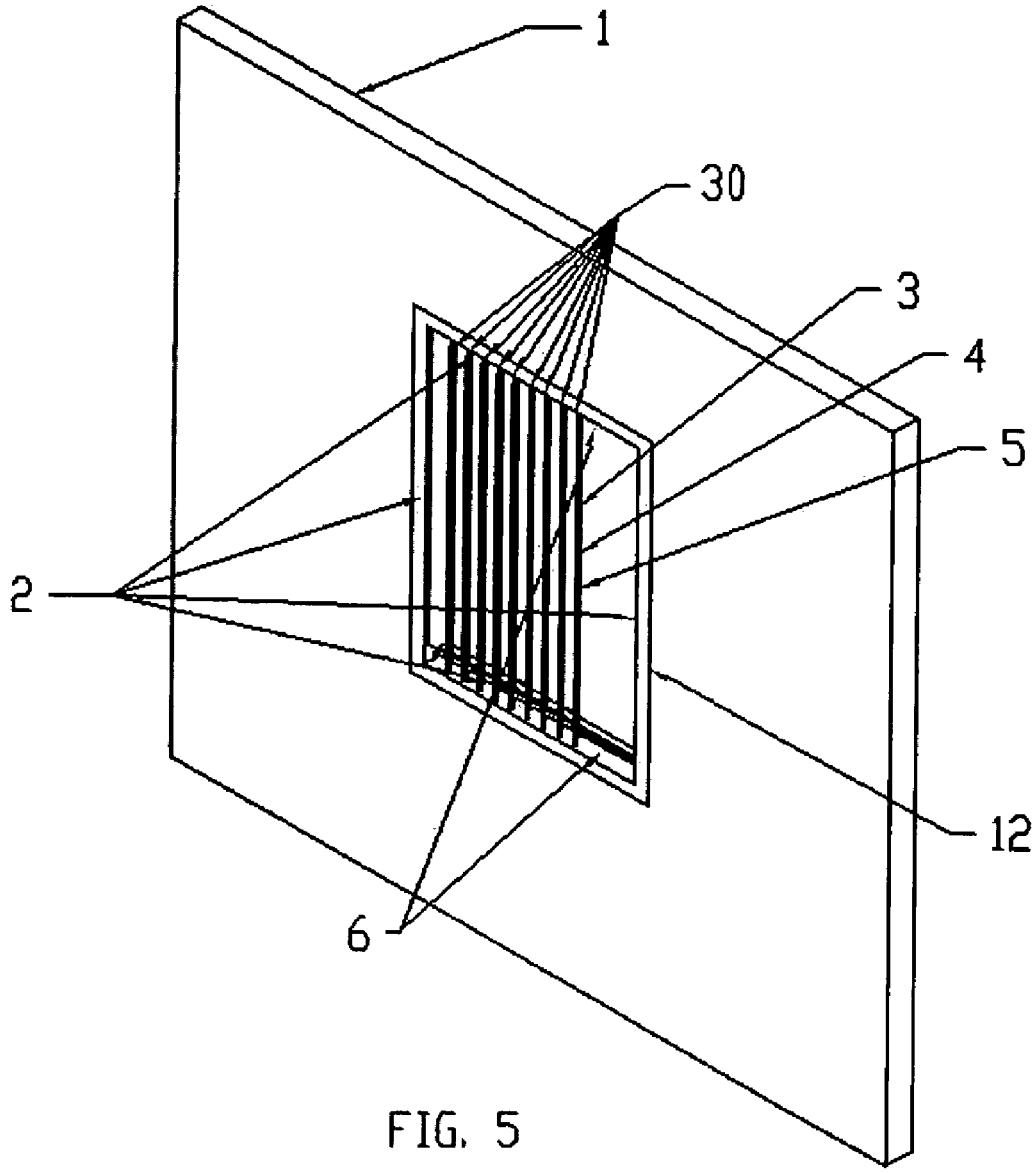
FIG. 5 is a perspective view of a preferred embodiment of vertical vanes covering installed inside a window frame.

In another preferred embodiment shown in FIG. 5, a partial wall section 1 is shown. In this embodiment vertical vanes 30, or slats, are shown installed inside a window frame 12 or door frame (not shown). The vanes 30 are made of three layers. The outer decorative layer 3 is made of wood, plastic or any rigid material. An inner layer 4 is made of an acoustic material designed with high sound attenuation characteristics to block sound transmission through the vane. An additional layer 5 facing the window or door, in other words, towards a sound emission, is made of an acoustic material designed with high sound absorptive characteristics. The vanes 30 are designed to overlap when closed so there are no gaps between the vanes 30. The vanes 30 are attached to a track 6 at the top and bottom of the window frame 12. The tracks 6 are sealed to the window frame or doorframe 12 with a flexible gasket 2. The tracks 6 can translate the vanes 30 from fully open to fully closed as well as rotate the vanes 30.

Figure 6:
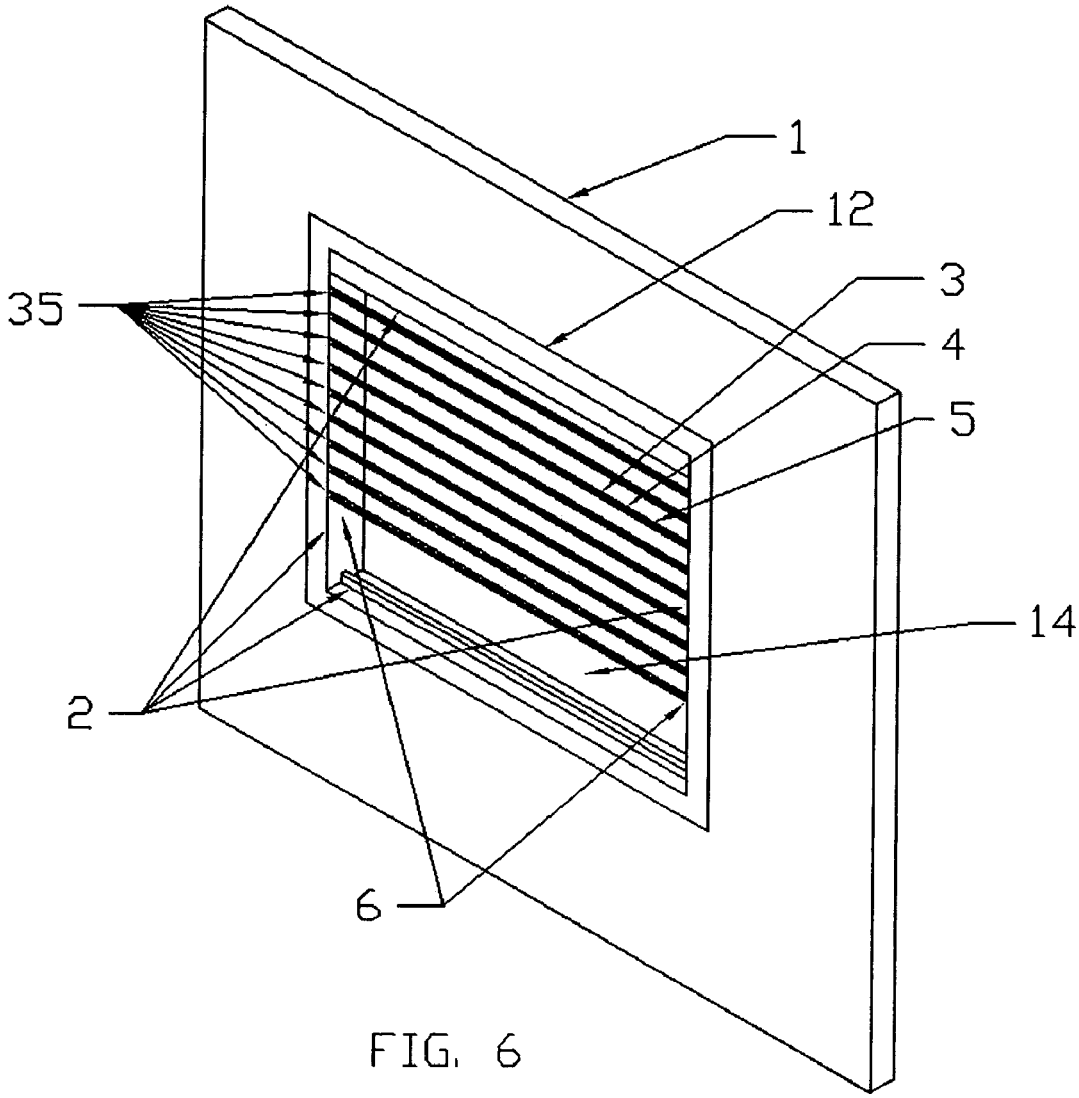
FIG. 6 is a perspective view of a preferred embodiment of a horizontal vane covering installed outside a window frame.

In FIG. 6 an exemplary embodiment of the invention is shown as horizontal blinds. A partial wall section 1 is shown. In this embodiment horizontal vanes 35, or slats, are shown installed inside a window frame 12 or door frame (not shown). The vanes 35 are shown to be made of three layers. The outer decorative layer 3 is made of wood, plastic or any rigid material. An inner layer 4 is made of an acoustic material designed with high sound attenuation characteristics to block sound transmission through the vane. An additional layer 5 facing the window or door is made of an acoustic material designed with high sound absorptive characteristics. The vanes 35 are designed to overlap so there are no gaps between the vanes 35 when the vanes are closed. The vanes 35 are attached to a track 6 on both sides of the blinds. The tracks 6 are sealed to the window frame or doorframe with a flexible gasket 2. The tracks 6 can translate the vanes 35 from fully open to fully closed as well as rotate the vanes 35.

An exemplary example of the inner layer 4 that is made of an acoustic material designed with high sound attenuation characteristics to block sound transmission is a mass loaded vinyl. Currently, the sound transmission class rating (STC) for this material is 25 to 40 wherein the thickness of the material ranges from an eighth of an inch to a quarter of an inch. Those skilled in the art will recognize that in time, the STC ratings and thickness may improve or that the type of materials may be improved upon, such as new materials, composites, etc., which will also result in improved ratings. Towards this end, this invention is not limited to the current state of the technology.

An exemplary example of the additional layer 5 facing the window 14 or door that is made of an acoustic material designed with high sound absorptive is acoustically absorptive fabric. Such material is typically one sixteenth of an inch to half an inch thick. It has an outward surface similar to carpet, but without the heavy backing, wherein its acoustical absorption characteristics is attributed to it having a high surface area of fibers that absorb sound, preferably with a noise reduction coefficient (NRC) rating of 0.8 to 1.25. Those skilled in the art will recognize that in time, the NRC ratings and thickness may improve or that the type of materials may be improved upon, such as new materials, composites, etc. which will also result in improved ratings. Towards this end, this invention is not limited to the current state of the technology.

The outer layer 3 made of wood, plastic or any rigid material. In a preferred embodiment this layer is decorative in nature. For example, the outer layer may be configured to match cabinetry, molding, or furniture located within the room. When used as disclosed, the invention will result in a total noise reduction between 20 to 50 dB(A).

FIG. 7 shows an exemplary embodiment of a track and sealing mechanism that could be utilized with either a vertical vane or horizontal vane covering. In this embodiment, the vertical blind implementation as discussed above is shown installed inside a window frame 1 or door frame (not shown). A track mechanism 40 is provided above and below the vane 30, and attached to the window frame 12. The track mechanisms are able to rotate and translate the vertical vanes 30 about each vanes axis. On an edge 41 of each track mechanism 40, a flexible gasket 2, or seal, is placed that reaches to the window frame 12. When the vertical vanes 30 are in a fully closed position, the seals 2 provide a positive seal for the vanes against the track. Those skilled in the art will readily recognize that a similar embodiment can be used for horizontal vanes.

While the invention has been described in what is presently considered to be a preferred embodiment, many variations and modifications will become apparent to those skilled in the art. Accordingly, it is intended that the invention not be limited to the specific illustrative embodiment but be interpreted within the full spirit and scope of the appended claims.

What is claimed is:

1. An acoustical dampening barrier, for an opening in a wall, that is translatable to an open position to allow access to said opening, said acoustical dampening barrier comprising:

a first barrier layer made of at least one of a rigid and semi-rigid material;

a second barrier layer made of an acoustic material with sound attenuation characteristics to block sound transmission through the acoustical dampening barrier, the second barrier layer being fixed to said first barrier layer on a side of said first barrier layer where a sound to dampen is emitted;

a third barrier layer made of an acoustic material with sound absorptive characteristics fixed to said second barrier layer on a side of said second barrier layer where a sound to dampen is emitted, wherein said third barrier layer comprises a material with a noise reduction coefficient rating of 0.8 to 1.25;

a flexible seal material connected to at least one of said opening in said wall, said first barrier layer and said third barrier layer to further dampen a sound emitted when said acoustical dampening barrier is translated to a closed position to prevent access to said opening; and wherein when the acoustical dampening barrier is translated to a closed position, the acoustical dampening barrier fits at least one of within the opening in the wall and adjacent to said opening in said wall depending where the flexible seal is connected.

2. The barrier of claim 1 wherein said first barrier layer, said second barrier layer and said third barrier form at least one of a single door and a plurality of doors.

3. The barrier of claim 2 wherein when a plurality of doors are formed, said seal material is connected to close an area between at least one of where adjacent doors connect and where said door and said opening meet.

4. The barrier of claim 3 wherein said seal material is connected to edges of each said plurality of doors.

5. The barrier of claim 1 wherein said first barrier layer comprises at least one of wood, plastic, and vinyl.

6. The barrier of claim 1 wherein said second barrier layer comprises mass loaded vinyl.

7. The barrier of claim 1 wherein said second barrier layer comprises a material with a sound transmission class rating of 25 to 40.

8. The barrier of claim 1 wherein said third barrier layer comprises acoustically absorptive fabric.

9. An acoustic reduction system for use with at least one of a door and a window, said system comprising:

a barrier connected to at least one of an inner surface of a frame of at least one of said door and said window and an outer edge of said frame of at least one of said door and said window comprising:

a first barrier layer made of at least one of a rigid and semi-rigid material;

a second barrier layer fixed to said first barrier layer on a side of said first barrier layer where a sound to dampen is emitted made of an acoustic material with sound attenuation characteristics to block sound transmission through the acoustic reduction system; and a third barrier layer fixed to said second barrier layer on a side of said second barrier layer where a sound to dampen is emitted made of an acoustic material with sound absorptive characteristics, wherein said third barrier layer comprises a material with a noise reduction coefficient rating of 0.8 to 1.25; and a flexible seal material connected to at least one of said inner surface of said frame, said outer edge of said frame, and said barrier to close an opening between said frame and said barrier.

10. The system of claim 9 wherein said barrier forms at least one of a single door and a plurality of doors.

11. The system of claim 10 wherein when a plurality of doors are formed said seal material is connected to close an area between where adjacent doors connect.

12. The system of claim 11 wherein said seal material is connected to edges of each said plurality of doors.

13. The system of claim 9 wherein said first barrier layer comprises at least one of wood, plastic, and vinyl, and wherein said second barrier layer comprises a material with a sound transmission class rating of 25 to 40.

14. An improvement for a window shutter system having a plurality of decorative shutter slats that is placed at least one of inside an opening formed for a window and adjacent the window, said improvement comprises:

a first barrier layer made of an acoustic material with sound attenuation characteristics fixed to each individual decorative shutter slat of said plurality of decorative shutter slats on a side of said shutter where a sound to dampen is emitted;

a second barrier layer made of an acoustic material with sound attenuation characteristics to block sound transmission, the second barrier layer being fixed to said first barrier layer on a side of said first barrier layer where a sound to dampen is emitted; and a third barrier layer fixed to said second barrier layer on a side of said second barrier layer where a sound to dampen is emitted made of an acoustic material with sound absorptive characteristics, wherein said third barrier layer comprises a material with a noise reduction coefficient rating of 0.8 to 1.25.

15. The improvement of claim 14 further comprising a flexible seal material connected to at least one of each said individual decorative shutter slat and said second barrier layer to further dampen a sound emitted when said shutter slats are translated to a closed position.

16. The improvement of claim 15 wherein said second barrier layer comprises a material with a sound transmission class rating of 25 to 40.

* * * * *

UNITED STATES PATENT AND TRADEMARK OFFICE

CERTIFICATE OF CORRECTION

PATENT NO. : 7,562,743 B2
APPLICATION NO. : 11/004266
DATED : July 21, 2009
INVENTOR(S) : Schott et al.

It is certified that error appears in the above-identified patent and that said Letters Patent is hereby corrected as shown below:

THE TITLE PAGE SHOULD BE DELETED AND SUBSTITUTE THEREFOR THE ATTACHED TITLE PAGE

Signed and Sealed this

Sixth Day of October, 2009

David J. Kappos

David J. Kappos
*Director of the United States Patent and Trademark Office*

(12) United States Patent
Schott et al.

(10) Patent No.: US 7,562,743 B2
(45) Date of Patent: Jul. 21, 2009

(54) ACOUSTICAL WINDOW AND DOOR COVERING

(75) Inventors: Lisa A. Schott, Oviedo, FL (US); Joseph G. Gaddone, Oviedo, FL (US)

(73) Assignee: Quietly Making Noise, LLC, Oviedo, FL (US)

( * ) Notice: Subject to any disclaimer, the term of this patent is extended or adjusted under 35 U.S.C. 154(b) by 0 days.

(21) Appl. No.: 11/004,266

(22) Filed: Dec. 2, 2004

(65) Prior Publication Data

US 2006/0118356 A1 Jun. 8, 2006

(51) Int. Cl.
*E06B 5/20* (2006.01)

(52) U.S. Cl. ..... 181/287; 181/284; 181/285; 181/290; 181/294; 181/295; 160/216; 160/223; 160/229.1

(58) Field of Classification Search ..... 181/284, 181/286, 287, 290, 294, 295; 160/216, 223, 160/229.1, 117
See application file for complete search history.

(56) References Cited

U.S. PATENT DOCUMENTS

| | | | | | |
|---|---|---|---|---|---|
| 3,298,457 | A | * | 1/1967 | Warnaka | 181/290 |
| 3,472,305 | A | | 10/1969 | Lefes | |
| 4,214,646 | A | * | 7/1980 | Planes et al. | 181/287 |
| 4,276,954 | A | * | 7/1981 | Romano | 181/224 |
| 4,357,979 | A | * | 11/1982 | Marontate | 160/199 |
| 4,363,351 | A | | 12/1982 | Eriksen | |
| 4,387,760 | A | * | 6/1983 | Greschbach | 160/229.1 |
| 4,454,691 | A | * | 6/1984 | Mitchell | 52/202 |
| 4,488,619 | A | | 12/1984 | O'Neill | |
| 4,620,581 | A | | 11/1986 | Wallace | |
| 4,658,878 | A | * | 4/1987 | Williams | 160/84.09 |
| 4,863,791 | A | * | 9/1989 | Steward et al. | 428/310.5 |
| 4,961,454 | A | * | 10/1990 | Reilly et al. | 160/344 |
| 5,165,459 | A | | 11/1992 | Gaber et al. | |
| 5,203,129 | A | | 4/1993 | Johnson | |
| 5,287,909 | A | * | 2/1994 | King et al. | 160/135 |
| 5,334,806 | A | * | 8/1994 | Avery | 181/286 |
| 5,509,457 | A | * | 4/1996 | Jella | 160/201 |

(Continued)

FOREIGN PATENT DOCUMENTS

| | | |
|---|---|---|
| WO | WO 79/01168 | 12/1979 |

*Primary Examiner*—Jeffrey Donels
*Assistant Examiner*—Jeremy Luks
(74) *Attorney, Agent, or Firm*—Terry M. Sanks; Mark W. Scott; Beusse Wolter Sanks Mora & Maire, P.A.

(57) ABSTRACT

An acoustical dampening barrier, for an opening in a wall, that is translatable to an open position to allow access to the opening, the fixed barrier including a first barrier layer made of at least one of a rigid and semi-rigid material, a second barrier layer fixed to the first barrier layer on a side of the first barrier layer where a sound to dampen is emitted made of an acoustic material with sound attenuation characteristics, a third barrier layer fixed to the second barrier layer on a side of the second barrier layer where a sound to dampen is emitted made of an acoustic material with sound absorptive characteristics, and a seal material connected to at least one of the opening in the wall, the first barrier layer and the third barrier layer to further dampen a sound emitted when the fixed barrier is translated to a closed position to prevent access to the opening.

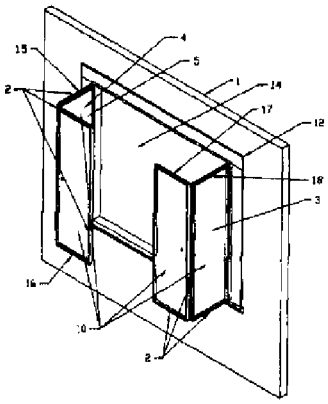

16 Claims, 7 Drawing Sheets